United States Patent [19]

Johnson

[11] 3,968,747

[45] July 13, 1976

[54] PRINTING APPARATUS

[75] Inventor: Leonard L. Johnson, Fort Wayne, Ind.

[73] Assignee: Lincoln Logotype Co., Inc., Fort Wayne, Ind.

[22] Filed: Jan. 27, 1975

[21] Appl. No.: 543,991

[52] U.S. Cl. ..... 101/376; 29/126; 267/140

[51] Int. Cl.[2] ..... B41F 13/10

[58] Field of Search..... 101/35, 36, 110, 375–377, 101/379, 380, 381; 29/124, 125, 126; 267/140, 141, 152, 153

[56] References Cited

UNITED STATES PATENTS

| | | | |
|---|---|---|---|
| 199,460 | 1/1878 | Morgans | 101/377 |
| 2,085,323 | 6/1937 | Leash | 101/376 |
| 2,475,524 | 7/1949 | Scott et al. | 101/376 |
| 2,761,547 | 9/1956 | Gehrer | 29/126 X |
| 2,804,968 | 9/1957 | Elliot et al. | 29/126 X |
| 2,910,938 | 11/1959 | McKenzie | 101/377 |
| 3,467,010 | 9/1969 | King | 101/376 |
| 3,677,017 | 7/1972 | Shirvany | 267/140 X |
| 3,824,932 | 7/1974 | Aronson | 101/377 |

*Primary Examiner*—Edgar S. Burr
*Assistant Examiner*—Edward M. Coven

[57] ABSTRACT

A printing apparatus comprises a wheel having at least two spaced parallel sides. A type-supporting member is slidably mounted between said sides for radial movement, the wheel being open radially outwardly from this supporting member to receive a segment of rubber type. A spring of resilient, rubber-like material, in columnar form extends radially of the wheel between the sides, being secured at its radially outer end to the supporting member and at its inner end to the central portion of the wheel. Radially inward movement of the supporting member causes flexure of said spring which reacts with a corresponding force. A type segment mounted on said type-supporting member will be impressed against a surface to be imprinted depending upon the reactionary force exerted by the flexed spring. Since the spring is in columnar form, the reactionary force exerted by the spring is fairly constant for varying degrees of flexure thereby providing a fairly uniform force of engagement of the type face with an irregular surface as the type face moves between the high and low points thereon.

23 Claims, 13 Drawing Figures

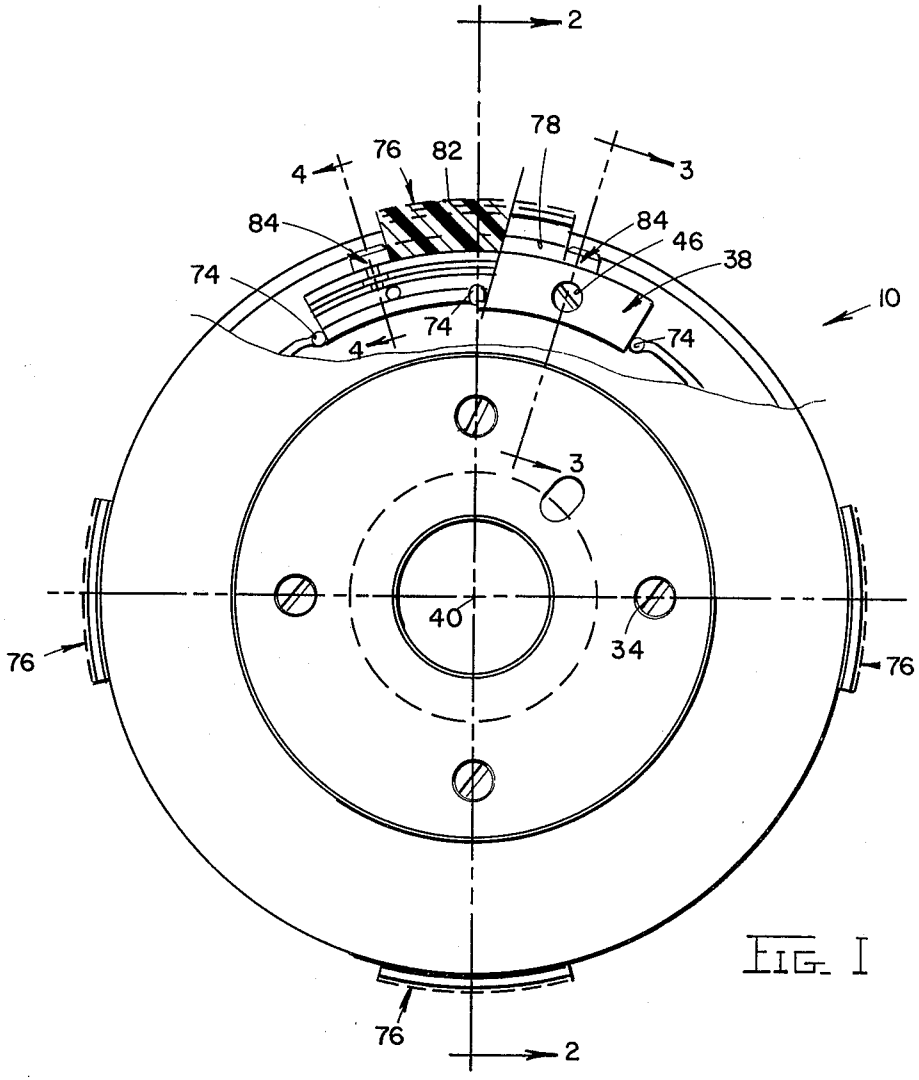
FIG. 1
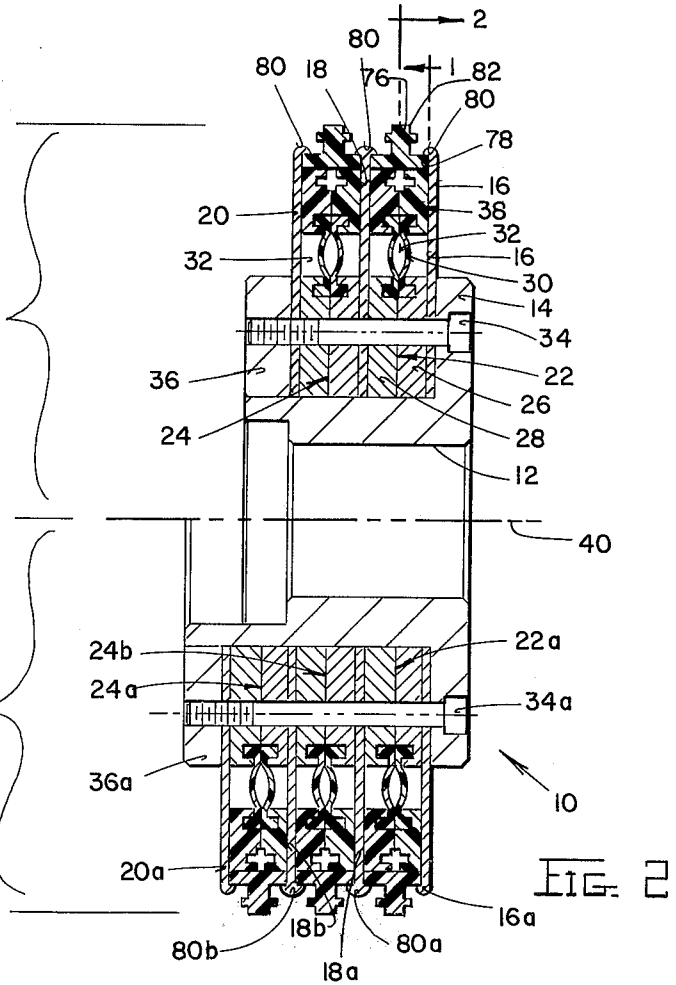
FIG. 2a
FIG. 2b
FIG. 2

PRINTING APPARATUS

BACKGROUND OF THE INVENTION

1. Field of the Invention

The present invention relates generally to printing apparatus, and more particularly to a printing wheel which carries type formed of resilient material, such as rubber, on its periphery for printing indicia, symbols or the like on flat, irregular or uneven surfaces.

2. Description of the Prior Art

In connection with the manufacture of packaged goods, it is conventional to print information, such as date codes, names and the like, in ink on the packages as they are being conveyed at a high rate of speed. Such packages may be of metal, plastic, cardboard, glass and the like, which in many instances present uneven and irregular surfaces on which a printing impression is to be made.

The type conventionally used is relatively soft rubber such that the force of type imprint can determine the clarity of the print. If too forceful, the type distorts and produces an unclear print or smudge. Elongated type segments of rubber usually carry a number of letters or numbers in seriatim. If the surface to be imprinted is irregular, the segment must essentially conform to such irregularities or else some of the parts of the surface will not be imprinted while others will be smeared.

Various printing wheel devices and rubber type designs have heretofore been employed to make clear imprints, at high speeds, on irregular surfaces, certain of these being the subject of U.S. Pat. Nos. 3,071,071, 3,093,070, 3,230,880 and 3,327,624. Such devices in various respects rely on the yieldability of the type or type segment in an attempt to secure a fairly uniform imprinting force of all of the type elements on an irregular surface being imprinted. However, if the type segment is not sufficiently yieldable at a high point on the surface, undue force can occur causing a distorted or smeared imprint to be made.

SUMMARY OF THE INVENTION

This invention is unique in that it functions to apply a more uniformly yieldable type structure whereby high points on an irregular surface will be impressed with about the same force as the lower points. It is further unique in that it functions to imprint simultaneously multiple parallel lines, automatically compensating for surface irregularities between lines.

The printing apparatus of this invention includes a wheel having two spaced sides. A support member is slidably mounted between the sides for radial movement. The wheel is opened radially outwardly from this support member for receiving a type segment which is engaged by and radially positioned by said support member.

A spring of resilient, rubber-like material, in columnar form extends radially of said wheel between said sides. At its radially outer end, the spring is secured to the support member and at its inner end to the central portion of the wheel whereby radially inward movement of the support member causes flexure of the spring. By reason of the columnar form of this spring, it will exert a fairly uniform reactionary force for different degrees of flexure. Therefore, the force of type imprint on an irregular surface is fairly uniform as between the high and low points thereon.

It is an object of this invention to provide a printing apparatus which may be operated at high speed in making clear imprints on irregular surfaces.

It is another object of this invention to provide an apparatus for imprinting parallel lines simultaneously, compensating for surface irregularities between lines.

The above-mentioned and other features and objects of this invention and the manner of attaining them will become more apparent and the invention itself will be best understood by reference to the following description of an embodiment of the invention taken in conjunction with the accompanying drawings.

BRIEF DESCRIPTION OF THE DRAWINGS

FIG. 1 is a side view substantially to scale of one embodiment of this invention partly broken away and sectioned;

FIG. 2, divided into parts FIGS. 2*a* and 2*b*, is a cross-section substantially to scale taken substantially along section line 2—2 of FIG. 1, FIG. 2*a* showing an embodiment for printing two parallel lines and FIG. 2*b* an embodiment for printing three parallel lines;

DESCRIPTION OF THE PREFERRED EMBODIMENT

Figure 11:
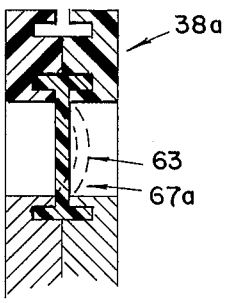
FIG. 11 illustrates in radial section a different design of the assembly shown in FIG. 3.

Referring to the drawings and more particularly to FIGS. 1 and 2, the apparatus of this invention is generally in the form of a printing wheel denoted generally by the numeral 10. The wheel 10 includes a cylindrical hub 12 having an end flange 14. Telescoped onto the hub 12, and now referring primarily to FIGS. 1 and 2*a*, are three planar wheel sides 16, 18 and 20 of equal size which are equally spaced apart by means of two spacer ring assemblies generally indicated by the reference numerals 22 and 24, respectively. Each of the assemblies 22 and 24 and includes a pair of ring-plates 26 and 28. With the spacer ring assemblies 22 and 24 being of equal thickness and diameter, two radial cavities are formed between the respective plates 16 and 18 on the one hand and 18 and 20 on the other, these cavities being denoted by the numerals 30 and 32, respectively.

The parts thus far described are secured together by means of threaded fasteners 34 which pass through axially aligned openings in the end flange 14, the wheel sides 16, 18 and 20, and the spacer ring assemblies 22 and 24, the distal ends of the threaded fastener 34 being threaded into a clamping ring 36 telescoped onto the hub 12 and abutted against the wheel side 20. The assembly thus far described is of rigid construction and can be mounted on a suitable shaft for rotation at high speed.

In FIG. 2*b* is illustrated the same structure as shown in FIG. 2*a* with the exception that an additional wheel side 18*b* is mounted on the hub 12 in spaced relation from the previously described wheel sides here denoted as 16*a*, 18*a* and 20*a*. An additional spacer ring assembly 24*a* like assemblies 22 and 24 is also telescoped onto the hub 12 thereby providing a total of four wheel sides 16*a*, 18*a*, 18*b* and 20*a* equally spaced apart by the spacer ring assemblies 22*a*, 24*b* and 24*a*. Threaded fasteners 34*a* thread into a clamping ring 36*a* of slightly different design than ring 36 as shown for securing these latter parts onto the hub 12. Additional wheel sides and related assemblies may be axially stacked in the same manner as described in order to obtain a final wheel assembly for printing the number of parallel lines desired as will be explained later.

Since the parts assembled in each wheel cavity 30, 32 are identically formed, a description of those parts in one cavity will suffice for all.

Figure 5:
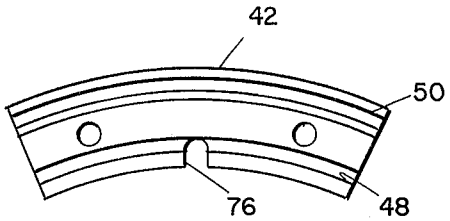
FIG. 5 is the side view of one arcuate plate of the type-supporting member as viewed substantially along section line 5—5 of FIG. 4.

Slidably fitted in the wheel cavity 30 is a type support member generally indicated by the reference numeral 38 formed of lubricous plastic, such as nylon or delrin. This support member 38 is partially shown in side view in FIG. 1 and in cross section in FIGS. 3 and 4. FIG. 5 is a side view of one of the two plates of the support member described in the following.

The support member 38 generally is arcuately shaped, having a radius of curvature about the wheel axis 40. It is composed essentially of two arcuate plates 42 and 44 secured together by means of suitable threaded fasteners 46. These plates are allochirally formed with arcuate grooves having a radius of curvature conforming to that of the support member 38 itself, the radially inner groove being indicated by the numeral 48 and the outer groove by the numeral 50. As shown, each of the plates 42 and 44 contains one-half of each of these grooves. The part cylindrical outer surface 52 of the support member 38 has an arcuate slot 54 therein which is narrower than the slot 50 and communicates therewith. Also, there is an arcuate groove 56 centrally below the groove 50 for a purpose which will be explained later. In the inner side 58 of the support member 38 is another arcuate groove 60 of narrower dimension which communicates with the groove 48. The purpose of this smaller groove 60 will be explained later.

The support member 38, referring to FIG. 2, slidably fits for radial translatory and rocking motion between the two wheel sides 16 and 18, these being spaced apart just sufficiently to provide the necessary clearance for this purpose.

Figure 3:
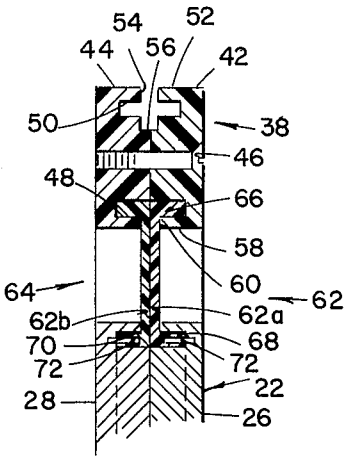
FIG. 3 is a radial cross-section of the assembly of the type support member, the annular rubber spring and the spacer ring shown also in FIG. 2.
Figure 7:
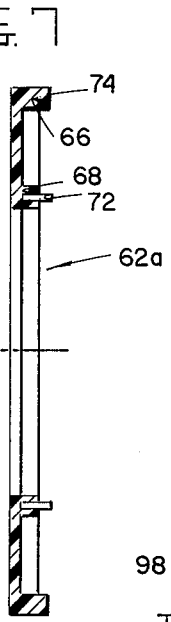
FIG. 7 is a cross-section taken substantially along section line 7—7 of FIG. 6.
Figure 4:
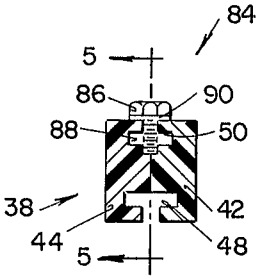
FIG. 4 is a cross section of the type-supporting member taken substantially along section line 4—4 of FIG. 1.
Figure 6:
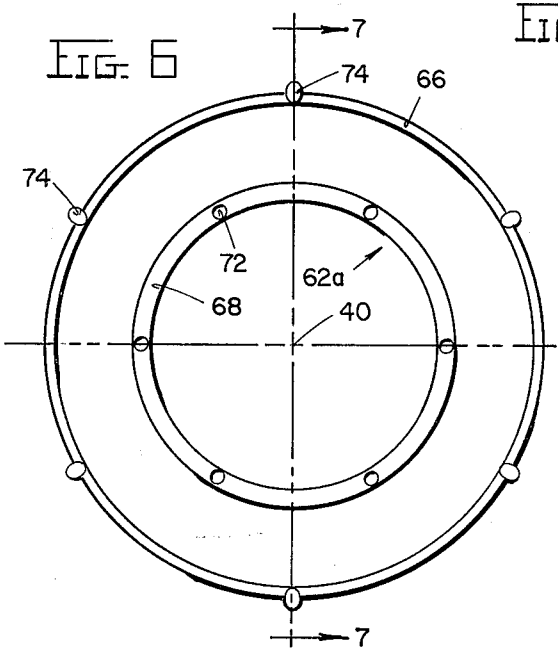
FIG. 6 is a side view of the annular rubber spring used in the embodiment of FIGS. 1 and 2.

A rubber spring of annular configuration, shown more clearly in FIGS. 6 and 7 is indicated generally by the numeral 62, this spring being composed of two identically formed annular pieces 62*a* and 62*b* disposed back-to-back as shown more clearly in FIG. 3. Generally speaking, the spring 62 in cross section is H-shaped having a central web portion 64 and two end flanges 66 and 68, respectively. The web portion 64 is positioned in the wheel cavity 30 (FIG. 2) to lie in a plane normal to the axis 40 of the wheel. The flanges 66 and 68 are cylindrical and fit respectively in the grooves 48 and 60 of the support members 38 (there being four circumferentially spaced in the embodiment shown in FIG. 1)

while the flange 68 fits into a companion annular groove 70 formed in the spacer ring assembly 22. With the webs of the two halves 62*a* and 62*b* back-to-back as shown in FIG. 3, and moving a support member 38 radially inwardly a short distance, the web will be flexed or deformed outwardly slightly as shown in FIG. 2. Being so flexed, the webs will exert a radially outward force tending to move the support member 38 outwardly.

In cross section, the web 64 of the joined parts 62*a* and 62*b* resembles a spring column and when flexed as shown in FIG. 2 corresponds to a loaded column. In theory, the radial force exerted by the spring when flexed as shown in FIG. 2 resembles that of the critical buckling load on a column. For small increases in load, the column deflects substantially. This column may be considered to have a low spring rate which exerts a nearly constant force for different degrees of buckling, or in other words, for different distances of radial movement of the support member 38. The web 64 as shown in FIG. 3 with the two planar portions of the halves 62*a* and 62*b* abutted together as shown is in membrane form having parallel sides and a thickness and radial length such as will produce the spring force desired. In a working embodiment of this invention, the halves 62*a* and 62*b* are molded of relatively soft rubber, but it is to be understood that other flexible, resilient materials may be used instead.

In FIG. 11 is shown an alternative design for the spring ring 62, this being denoted by the numeral 67*a*. Instead of two annular elements 62*a* and 62*b* back-to-back, the spring ring 67*a* is molded as a single member capable of flexing along the dashed lines denoted by the numeral 63. When inserted in the assembly as shown in FIG. 2, the spring will be normally buckled as there shown.

Referring to FIGS. 3, 6 and 7, the flange 68 of each of the halves 62*a* and 62*b* have axially extending pins 72 molded thereinto and are spaced circumferentially as shown. These pins 72 fit into companion recesses in the ends of the groove 70 in the spacer ring 72. Thus, the spring ring 62 is locked for rotation with the spacer ring 22.

Integrally molded as a part of the outer flange 66 are a plurality of circumferentially spaced radially protruding bosses 74. These bosses are spaced in relation to the length of the arcuate support member 38 to engage the ends thereof as shown in FIG. 1 and also to fit into a centrally positioned recess 76 in the support member 38 as shown in FIGS. 1 and 5. The support member 38 is thus locked for rotation with spring ring 62.

Segments of rubber type 76, these segments generally being H-shaped in cross section to define an elongated, rectangular base portion 78. This base portion 78 is abutted against the outer part-cylindrical surface of the support member 38 and is normally urged against the inturned flanges 80 on the perimeters of the wheel sides 16, 18 and 20. The type face 82 therefor projects beyond the wheel periphery and defines an arcuate surface having a center of curvature about the wheel axis 40. The base portion 78 of the type segment is sized such that it can be moved radially between the two wheel sides 16 and 18 such that moving the type 76 radially inwardly as shown in FIG. 2 will result in the support member 38 also moving inwardly and the further flexing of the spring ring 62. Releasing the force on the type segment 76 results in the spring force moving the support member 38 and the type segment 76 outwardly until the base portion 78 engages the inturned flanges 80.

For locating the type segment 76 circumferentially on the support member 38, two stop elements 84, secured to the support member 38 are abutted against the opposite ends thereof. The stop elements are shown more clearly in FIG. 4 and are composed essentially of threaded fasteners. These threaded fasterners include a screw having a head 86 and a nut 88. The nut 88 is received by the groove 50 in the support member 38 with the flat sides thereof being engageable with the sides of the groove 50 thereby to prevent rotation of the nut. A washer 90 is provided between the head 86 and the outer surface of the support member 38. Thus, by tightening the screw into the nut 88, the fastener is clamped onto the support member 38. For initially adjusting the type segment 76 to a desired circumferential position on the wheel, the threaded fasteners are loosened, the type segment 76 is positioned and then the threaded fasteners are abutted against the opposite ends of the type segment and there tightened.

Since the support members 38 are preferably of thermo plastic material, it is possible to mold over or form a portion of the opposite ends of the support member 38 adjacent the groove 50 for preventing the nuts 88 from escaping therefrom.

In the embodiment shown in FIG. 1, four type segments 76 and support members 38 are orthogonally disposed about the wheel with the type faces 82 radially projecting therefrom and lying on a common circle having a center on the axis 40. It is obvious that different numbers of type assemblies may be employed without departing from the spirit and scope of this invention.

Figure 8:
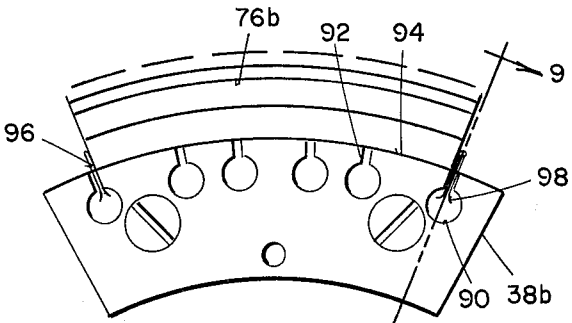
FIG. 8 is a partial side view of another form of the type-supporting member.
Figure 9:
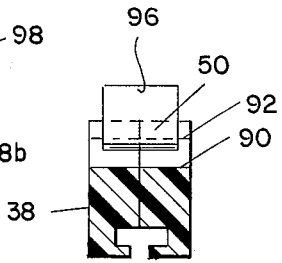
FIG. 9 is a sectional view taken substantially along section line 9—9 of FIG. 8.
Figure 10:
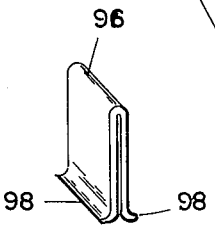
FIG. 10 is a perspective of one of the spring metal stops used with the supporting member of FIG. 8.

A slightly different design of a support member 38 is shown in FIGS. 8, 9 and 10, like elements being indicated by the same numerals with the suffix letter *b* added. In this design, the support member 38 is formed with a number of transverse holes 90 therethrough having slots 92 extending to the outer surface 94. Each hole and slot 90, 92 receives a flat spring element 96 bent to a flattened U-shape with the ends 98 being flared. The springs 96 are sufficiently long as to project radially beyond the support member surface 94 when inserted into a hole-slot 90, 92 wherein the flared ends 98 are received by the hole 90 and the shank of the spring by the slot 92. The shank of the spring is preformed such that it will lightly engage frictionally the sides of the slot 92 so as to be retained therein.

Two such springs 96 are shown mounted in position on the support member 38*b* and serve as stop elements engaged with the opposite ends of the type segments 76*b*. Variously spaced hole-slot combinations 90, 92 permit using type segments 76*b* of different lengths.

In operation, the wheel 10 with the various type segments 76 fastened thereto is mounted on a shaft driven at a high rate of speed. Containers or packages to be imprinted are passed beneath the wheel 10 at about the same lineal speed as that of the periphery of the wheel 10, each article being engaged by the type faces 82. With the type face pressed there against, an imprint is made on the surface. If the surface being imprinted is irregular, such as being slightly concave or convex, and the axis 40 of wheel rotation is fixed, the type section 76 will be deflected radially of the wheel a distance corresponding to the surface irregularity. Since as explained previously the spring rate of the spring ring 62 is substantially constant, radial displacement of the type segment 72 during printing and the support member 34 is yieldably opposed with a constant force; thus, the force the type face 62 incrementally exerts along its length against the surface being imprinted remains substantially constant such that the type face is not distorted or unduly compressed. A clear imprint by reason of the uniform force of type engagement with the surface being imprinted results.

Inasmuch as surfaces being imprinted can be high at the beginning of the print and lower at the end thereof or vice versa, it is necessary that the type segment 76 conform thereto. Such a condition would cause one end of the type segment to flex more than the other. This is accommodated by the slidable mounting of the support member 38 between the wheel sides 16 and 18 and the fact that the spring ring 62 can disproportionately flex along its circumferential extent. A rocking motion of the type segment 76 and support member 38 will result, which permits the type face 82 to conform to the surface being imprinted.

It will now be apparent that the spring mounted of the type segment 76 permits both translational and rocking movement radially of the wheel. By reason of the uniform spring rate, a substantially constant force will be exerted by the type segment onto the surface being imprinted as the wheel 10 rotates.

As explained previously, the configuration of the spring ring 62, and more particularly the web portion 64, resembles a loaded column which provides a spring rate of nearly constant force with changes in flexure or buckling. The result is a type mounting which permits printing on highly irregular surfaces.

Since each of the wheel cavities, as shown in FIG. 2, contain the same type-mounting structure, it will be obvious that multiple, parallel lines may be printed simultaneously, with the type mountings automatically compensating for surface irregularities between lines. In other words, the type segments for each line act independently so as to provide clear imprints.

This invention may be embodied in wheel assemblies employing mounting for only single type lines or mountings for multiple lines as is obvious upon observing FIG. 2.

Recapitulating, this invention provides for independent printing action as between lines, a yieldable, floating action of the type segment itself both translational and rocking radially of the wheel, and a substantially constant printing force while imprinting irregular surfaces.

By making the support member 38 as low weight as possible (of low density material) the low mass of the type segment coupled with the soft spring rate of the annular spring 62 enhances clear printing at high speeds. This type of suspension system that minimizes friction as well as mass effect causes the printing force on the type face to be nearly constant throughout a wide speed range and thereby prevents type face distortion during printing and resultant smear.

Dimensions of a working embodiment are given in inches in the following it being denoted that these are given by way of example only and can be varied without departing from the spirit and scope of this invention.

| | |
|---|---|
| Outside diameter hub 12 | 1.750 |
| Outside diameter sides 16, 18, 20 | 3.875 |
| Spacing between plates 16, 18, 20 | .375 |
| Outside Diameter spacer rings 22, 24 | 1.750 |

-continued

| | |
|---|---|
| Arcuate length support member 38 | 45° to 60° |
| Radial thickness support member 38 | .438 |
| Outside diameter of rubber spring 62 | 3.125 |
| Thickness of each webb of spring 62a, 62b | .035 |
| Axial length of flanges 66, 68 | .125 |
| Radial length of web 64 of spring 62 | .625 |
| Durometer of rubber of spring 62 | 45 |
| Radial spacing between support member 38 and spacer ring 22 | .438 |

While there have been described above the principles of this invention in connection with specific apparatus, it is to be clearly understood that this description is made only by way of example and not as a limitation to the scope of the invention.

What is claimed is:

1. Printing apparatus comprising a wheel having two spaced sides, a support member mounted between said sides for radial movement, means for limiting the outward radial travel of said member, said wheel being open radially outwardly from said support member, a spring of resilient, rubber-like material, in buckled columnar form extending radially of said wheel between said support member in its outermost radial position and the central portion of said wheel, said buckled columnar spring being secured at its radially outer end to said support member and at its inner end to said central portion of said wheel whereby radially inward movement of said support member causes lateral bowing of said spring with the force exerted by the spring in opposition to the radially inward movement remaining nearly constant over the range of support member radial movement, and type-supporting means including said support member and wheel sides for supporting a type segment in said open portion of said wheel.

2. The printing apparatus of claim 1 in which said spring further is of web form that generally defines a plane radially of said wheel.

3. The apparatus of claim 2 in which said support member slidably engages said wheel sides, said spring further being of annular form coaxial with respect to said wheel.

4. The apparatus of claim 3 including a plurality of said support members spaced circumferentially of said wheel, each support member being secured to said annular spring whereby each support member is independently yieldably urged radially outwardly.

5. The apparatus of claim 2 in which said spring is a single membrane-like element.

6. The apparatus of claim 2 in which said spring includes two juxtaposed membrane-like elements.

7. The apparatus of claim 4 in which said type-supporting means includes inturned flanges on the peripheries of said wheel sides, respectively, thereby defining radial spaces between said support members and said flanges, respectively, for receiving type segments.

8. The apparatus of claim 7 in which each support member is arcuately shaped to conform generally to the circumference of said wheel, each support member having a part-cylindrical outer surface coaxial of said wheel, and including two stop elements secured to each support member to project radially beyond the outer surface thereof and for circumferential adjustment thereon.

9. The apparatus of claim 4 in which said wheel includes a hub having a cylindrical outer surface and an end flange, said wheel sides being telescoped onto said hub and operatively engaging said end flange, and means for removably securing said sides to said hub.

10. The apparatus of claim 9 in which there are three of said sides axially spaced apart thereby defining two radial cavities each receiving said support members and springs as aforesaid, two spacer rings on said hub and disposed in said cavities for spacing said wheel sides, respectively, apart, said spacer rings being the aforesaid central portion of said wheel to which said two annular springs are secured, the facing surfaces of said wheel sides being flat and parallel and extending radially of said wheel, said securing means including threaded fasteners which extend axially through said hub flange, said wheel sides and said spacer rings.

11. The apparatus of claim 3 in which said wheel sides are laterally aligned and have facing surfaces, the facing surfaces of said wheel sides are flat and parallel and define planes normal to the wheel axis, said support member being arcuately shaped and having a center of curvature substantially coincident to the wheel axis; said support member including two abutted arcuate plates mounted between said sides for slidable radial movement therebetween, said arcuate plates being of lubricous plastic material.

12. The apparatus of claim 11 including a spacer ring coaxially received between said sides radially inwardly of said annular spring that constitutes the central portion of said wheel, and said spacer ring including two abutted ring-shaped plates that clamp therebetween an inner perimetral portion of said annular spring.

13. The apparatus of claim 12 in which an arcuate cavity, coaxial about the axis of said wheel, is provided between said arcuate plates, said annular spring having an outer perimetral flange an arcuate segment of which being fixedly received by said arcuate cavity, said spacer ring having a coaxial annular cavity between said ring-shaped plates, and said annular spring having an inner perimetral flange fixedly received by said annular cavity.

14. The apparatus of claim 13 in which said wheel includes a cylindrical hub having an end flange, said wheel sides and spacer ring being telescoped over said hub and operatively secured to said end flange.

15. The apparatus of claim 14 in which there are three of said sides axially spaced apart and parallel defining two radial cavities therebetween, each radial cavity receiving a plurality of said support members circumferentially spaced mounted on a respective annular spring secured at its inner perimeter to the respective spacer ring, said spacer rings spacing the respective wheel sides apart, and threaded fasteners securing said sides and rings to said hub.

16. The apparatus of claim 15 in which said type-supporting means includes inturned annular flanges on the periphery of said sides, said sides being of common diameter, said threaded fasteners extending through said hub flange, said sides and spacer rings.

17. The apparatus of claim 16 in which said annular flanges are cylindrically shaped and the receiving cavities in said support members and spacer rings conform thereto, and the inner perimetral flange having a plurality of axially protruding circumferentially spaced pins therein which fit into companion recesses in the cavities of said spacer rings.

18. The apparatus of claim 8 in which said support member includes two abutted arcuate plates of lubricous plastic material, a coaxial arcuate first slot formed in said support member between said arcuate plates, said stop elements each including a screw threaded into a nut, each screw having a head, one of said screw head and nut having flat sides slidably received by said arcuate slot thereby to be held against rotation, a second coaxial slot in the periphery of said support member communicating with said first slot, said second slot having a width narrower than said first slot thereby to receive the shank of said screw with the other of said screw head and nut protruding above the periphery of said support member thereby to serve as a stop element, tightening said screw into said nut serving to clamp the screw and nut assembly onto the ledge of said support member formed between said first slot and said outer periphery.

19. The apparatus of claim 3 in which said spring includes two juxtaposed membrane-like elements that define planes normal to the axis of said wheel, said two elements each having cylindrical flanges projecting axially to one side thereof on the inner and outer perimeters thereof, said elements being secured to said support member with the flanges extending oppositely.

20. The apparatus of claim 19 in which said elements have the webs thereof axially contiguous with the flanges on one element extending oppositely away from the flanges on the other element, said support member gripping segments of the outer flanges thereby to secure them together.

21. The apparatus of claim 8 in which said support member includes two abutted arcuate plates of lubricous plastic material, said support member further having a plurality of transverse holes therethrough and communicating slots which open through the outer surface thereof, and said stop element including a U-shaped sheet spring having ends that flare outwardly, said spring being received by one of said slots and connecting hole with said flared ends being disposed in the hole and the sides thereof frictionally fitted in the slot, said spring projecting above said outer surface.

22. Printing apparatus comprising a wheel having two spaced sides, an annular spring device having an annular membrane-like web disposed between said sides and in a plane radially of said wheel, said spring device being secured at its inner peripheral portion to a central portion of said wheel, a type segment disposed between said sides for radial movement having a type face radially protruding beyond the peripheries of said sides, and means for mounting said type segment onto said annular spring device, said spring device flexing in a direction generally normal to the plane of the membrane to yieldably urge said type segment radially outwardly with a force which is substantially constant for small radial displacement of the type segment including stop means for limiting the radially outward movement of said type segment, said spring device normally yieldably urging said type segment against said stop means and being buckled when the type segment is against the stop means.

23. Printing apparatus comprising a wheel having two spaced generally parallel sides, a support member mounted between and slidably engaging said sides for radial movement, said wheel being open radially outwardly from said support member, a spring of resilient rubber-like material in columnar web form defining a plane coaxial with and extending radially of said wheel between said support member and the central portion of said wheel and having an outer perimetral portion, said columnar spring being secured at its radially outer end to said support member and at its inner end to said central portion of said wheel whereby radially inward movement of said support member causes flexure of said spring, and type supporting means including said support member and wheel sides for supporting a type segment in said open portion of said wheel, said support member being arcuately shaped and having a center of curvature substantially coincident with the wheel axis, said support member including two abutted arcuate plates of lubricous plastic material with an arcuate groove between the plates for clamping a section of the outer perimetral portion of the spring.

* * * * *